US006497347B1

(12) United States Patent
Feibelman et al.

(10) Patent No.: US 6,497,347 B1
(45) Date of Patent: Dec. 24, 2002

(54) DISPLAY HANGER AND METHOD OF USE

(75) Inventors: Jeffrey A. Feibelman, Providence, RI (US); David W. Brown, Cumberland, RI (US)

(73) Assignee: Display Technologies, Inc., Johnston RI ( * ) Notice: Subject to any disclaimer, the term of this patent is extended or adjusted under 35 U.S.C. 154(b) by 95 days.

(21) Appl. No.: 09/716,724

(22) Filed: Nov. 20, 2000

(51) Int. Cl.[7] ..... A47G 25/14
(52) U.S. Cl. ..... 223/87; 223/85
(58) Field of Search ..... 223/85, 92, 95, 223/89, 88, 94, 87

(56) References Cited

U.S. PATENT DOCUMENTS

| | | | | |
|---|---|---|---|---|
| 2,985,346 A | | 5/1961 | Meeker et al. | |
| 3,710,996 A | | 1/1973 | Smilow et al. | |
| 4,063,669 A | | 12/1977 | Smilow et al. | |
| 4,453,655 A | | 6/1984 | Smilow et al. | |
| 4,930,692 A | | 6/1990 | Smilow et al. | |
| 5,005,741 A | | 4/1991 | Kolton et al. | |
| 5,222,638 A | | 6/1993 | Kolton et al. | |
| 5,615,810 A | * | 4/1997 | Kolton et al. | 223/85 |
| 5,620,118 A | * | 4/1997 | Kolton et al. | 223/85 |
| 5,626,268 A | | 5/1997 | Kolton et al. | |
| 5,799,843 A | | 9/1998 | Hsu | |
| 6,299,039 B1 | * | 10/2001 | Hsu | 223/87 |

* cited by examiner

*Primary Examiner*—Bibhu Mohanty
(74) *Attorney, Agent, or Firm*—Slater & Michaelson

(57) ABSTRACT

A hanger having a novel construction including an engagement member, a foldable body portion having an upper end with a pair of continuous locking openings, and a lower or tail end with a two prong locking member which engages the locking openings in a secured or closed position is disclosed. In one embodiment, the prongs of the locking member include a tapered head having a locking projection that engages a rear planar surface of the body portion, between the locking openings, in order to discourage removal of the locking member from the locking openings in use. The combination of these features allows the belt hanger to be readily assembled, tamper resistant after assembly, and aesthetically pleasing.

20 Claims, 7 Drawing Sheets

DISPLAY HANGER AND METHOD OF USE

Description

1. Technical Field

The invention relates generally to a display device and, more specifically to an improved display hanger for a belt.

2. Background of Related Art

Various devices have been utilized over the years in order to hold and display numerous items to consumers. Traditionally, belt hangers have operated to compactly hold and display belts while discouraging theft of the belts by securing them to the hanger. Belt hangers should ideally be easy to assemble in order to hold an associated belt, display the belt in an aesthetically appealing manner, and be relatively difficult for a consumer to disengage in order to prevent theft. In addition, many belt hangers include a surface for displaying indicia such as the size, price, manufacturer name, and the like. A variety of different style belt hangers are known in the art.

For example, U.S. Pat. No. 3,710,996 discloses a belt hanger having a "folded tail" construction. The belt hanger includes a hook for engaging a support, and an elongated belt-engaging element (22) having a tapered opening (24) at an upper end which narrows from the front (13) of the hanger to the rear (14) of the hanger for receiving a locking member (34) supported at a lower end (33) of the belt engaging element. The belt-engaging element (22) further includes a slotted opening (26) located at the medial portion thereof for receiving the end of a prong of a conventional belt buckle. In use, the lower end (33) of the belt engaging element is inserted within the opening in the belt buck, and the prong of the belt buckle is inserted into the opening (26) of the belt engaging element. The lower end (33) of the belt engaging element is then folded over the belt buckle and the locking member is inserted into the tapered opening. The locking member has a frusto-conical shape head (36) in order to prevent removal of the head (36) from the tapered opening. While generally effective, problems during assembly arose when applying the hanger to the belt which compromised the retention force of the locking member, as described in U.S. Pat. No. 5,005,741.

U.S. Pat. No. 5,005,741 discloses a belt hanger with an enhanced belt retention. The device of the '741 patent includes a front planar surface (50') and a rear planar surface (52') with a tapered opening (35') disposed there between. Extending from the rear planer surface is an outwardmost wall part (54). The opening (35') is constructed to receive a locking projection (46) of locking member (48). The opening (35') has a diameter D1 in surface (50') which corresponds to the outer diameter D1 of the locking member (48). The diameter of the opening (35') then tapers to D3 and continues to taper to D2, which is the diameter measured within the outwardmost wall part (54), distal from the rear planar surface (52'). Thus, the '741 patent includes a tapered opening which extends beyond the rear of the main body of the belt hanger, in contrast to the '996 patent discussed above, where the openings are disposed and taper within the body portion, between the front and rear planar surfaces. The purpose of the '741 hanger, as disclosed in the specification, is to provide a hanger where the force involved in assembly of the hanger with a garment is substantially less than the force involved in disassembly of the hanger from joinder with the garment.

While generally effective, the aforementioned devices and others available in the art can still be difficult to operate during assembly. In addition, end-users of the devices continue to look for devices which are cost effective and aesthetically appealing. Accordingly, there is continued development in the art of improved display hangers.

SUMMARY

One object of the present invention is to provide a display hanger capable of being readily assembled, while being tamper resistant after assembly. Another object is to provide a display hanger which is aesthetically pleasing while displaying a belt thereon.

In accordance with one aspect, there is provided a hanger having a novel construction including an engagement member, a foldable body portion having an upper end with a pair of continuous locking openings, and a lower or tail end with a two prong locking member which engages the locking openings in a secured or closed position. In one embodiment, the prongs of the locking member include a tapered head including a locking projection that engages a rear planar surface of the body portion, between the locking openings, in order to discourage removal of the locking member from the locking openings in use. The combination of these features allows the display hanger to be readily assembled, tamper resistant after assembly, and aesthetically pleasing.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENT

Figure 1:
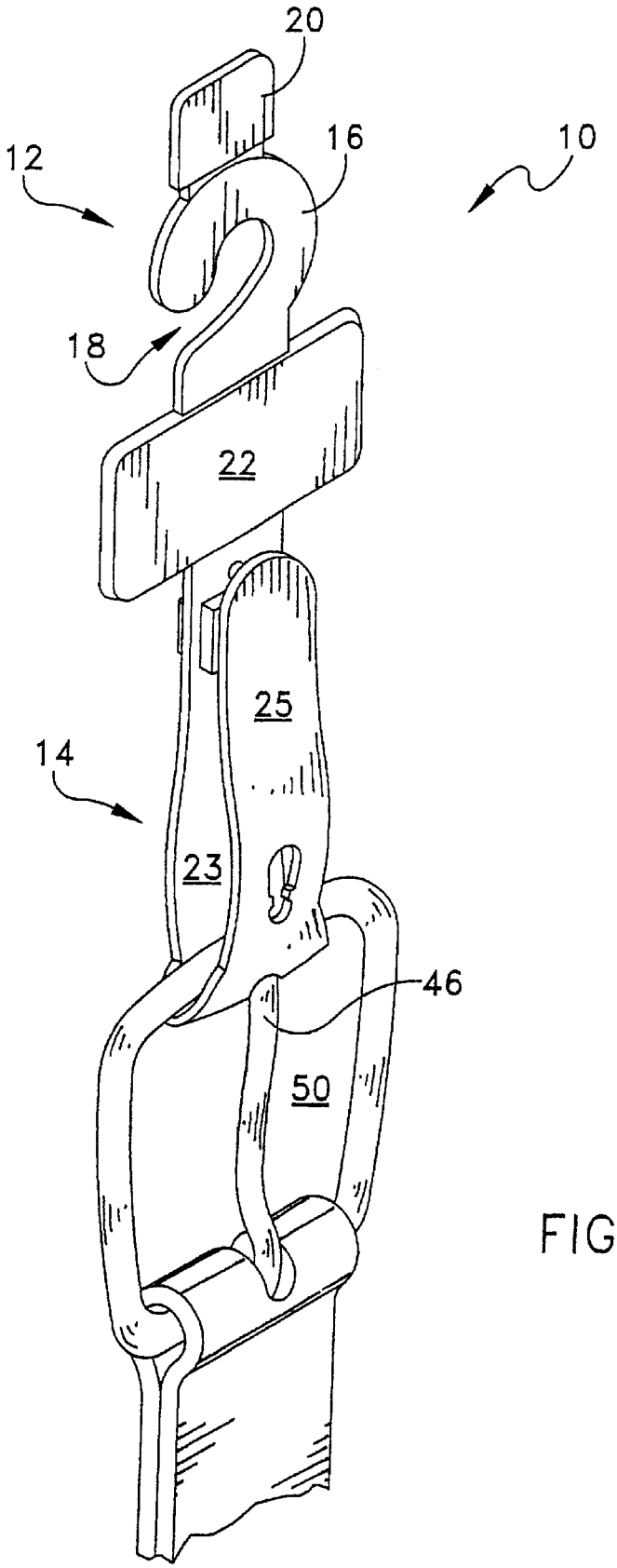
FIG. 1 is a perspective view of the display hanger, including a conventional belt, in a secured or closed position according to one embodiment of the present invention.

A display hanger 10 for displaying an article, such as a belt, is illustrated in FIGS. 1–8. As used herein, the term "article" refers to any type or style of clothing or ornamentation which may be used or worn. Also, as used herein, "belt" refers to any style or type of belt which may be worn by a user. The display hanger may preferably be formed as a unitary, molded semi-flexible plastic member which can be folded without breaking, as described below.

Referring to the figures, the display hanger 10 includes an engagement member 12 for securing the hanger to a display component, such as a rod, and an elongated body portion 14 supported by the engagement member. The display hanger 10 may have an overall length, "l" of between about 3⅛–7¾ inches with the present embodiment having an overall length of about 7 inches, although other lengths may readily be utilized as would be known to those of skill in the art. The engagement member 12 may take any of a variety of forms, suitable for engagement with a display component. Since the majority of display components are rods, the engagement member of the present embodiment is illustrated as a hook 16 including a recess portion 18 which permits the display hanger to be engaged with the display rod and hung therefrom. A tab 20 which may be utilized to indicate size and/or price may be supported on a top portion of the hook 16, as is known in the art. Likewise, a logo display area 22 may be supported on a bottom portion of the hook, between the hook 16 and the body portion 14. Although the tab 20 and the display area 22 are illustrated as generally rectangular in shape, other shapes may be utilized as would be known to those of skill in the art. Depending from the display area 22 is elongated body portion 14.

Figure 3:
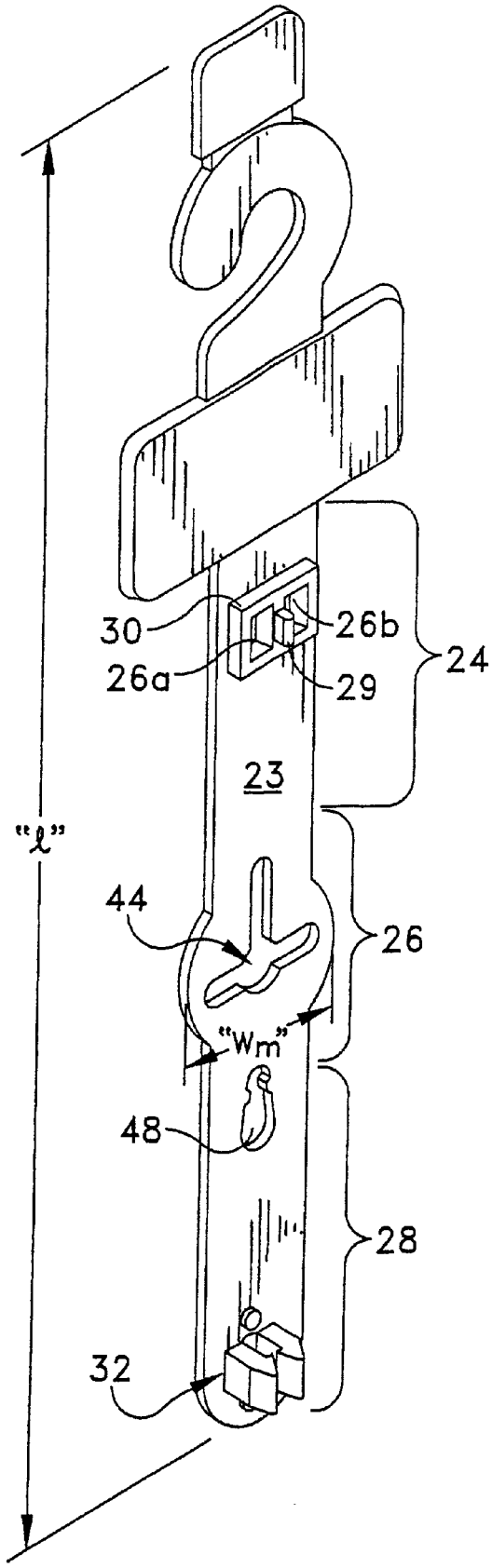
FIG. 3 is a perspective view of the embodiment of FIG. 1 in an open position.
Figure 4:
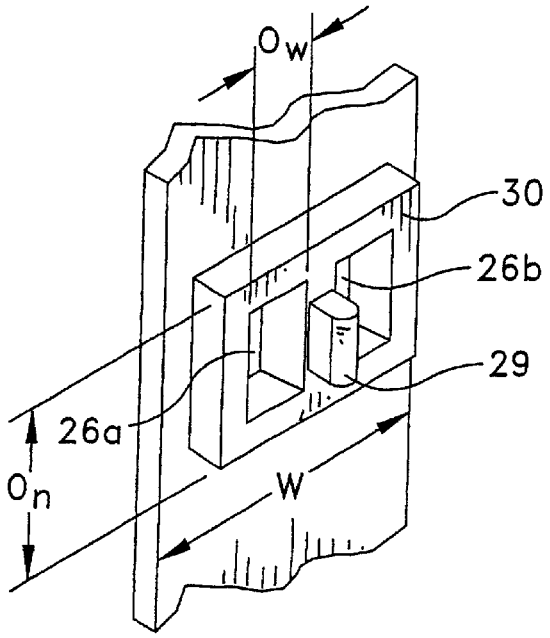
FIG. 4 is an enlarged perspective view of the locking openings of the belt hanger of FIG. 1.
Figure 8:
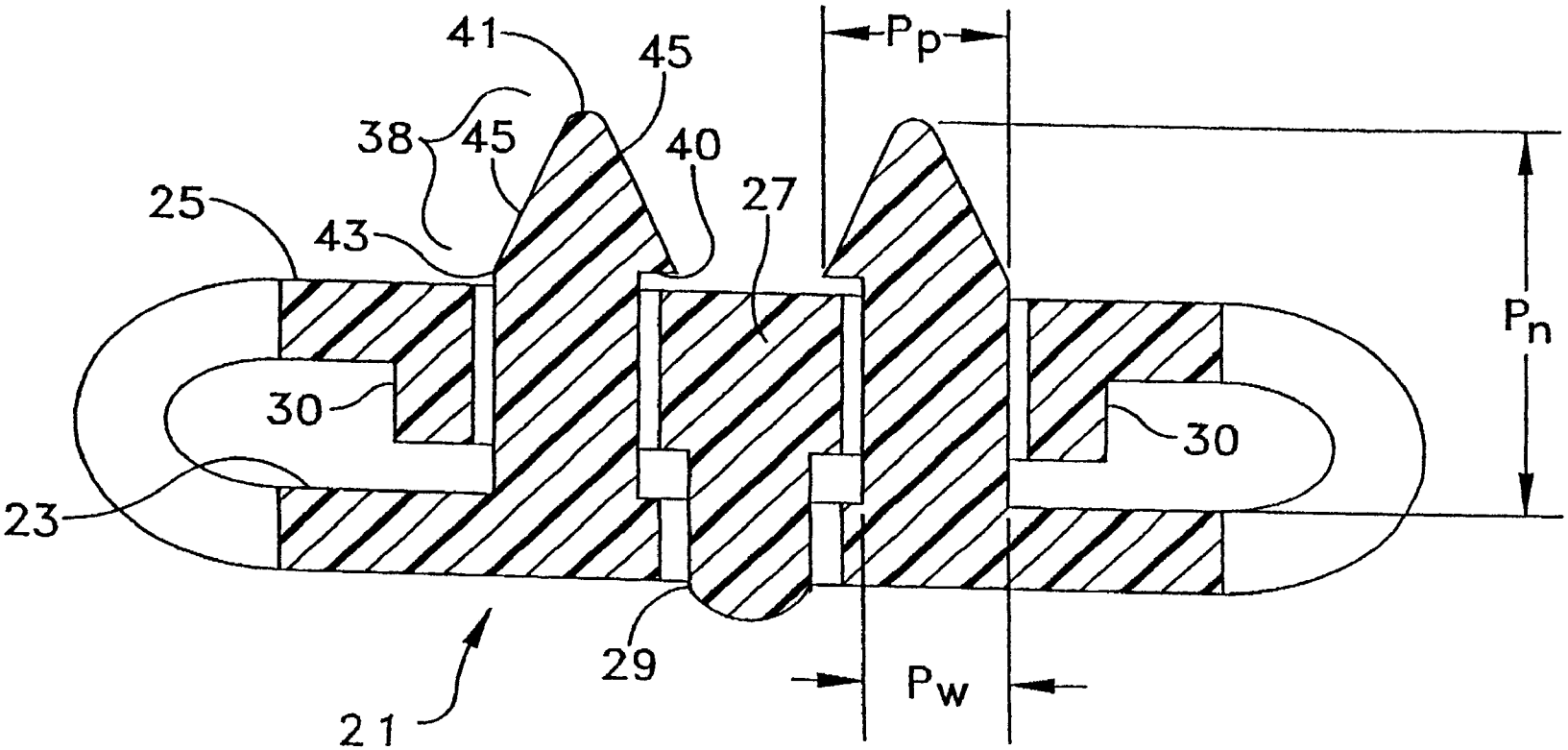
FIG. 8 is a top, cross-sectional view taken along lines 8—8 of FIG. 6.

Body portion 14 includes a front planar surface 23 and a rear planar surface 25. The body portion further includes an upper end 24 adjacent the display area 22, a median or fold area 26 extending therefrom, and terminates in a lower or tail end 28 (FIG. 3). In use, body portion 14 is foldable about the median area 26, and the tail end 28 is locked into the upper end 24 by a latching mechanism 21 in order to secure the belt to the hanger. The latching mechanism preferably includes a pair of locking openings 26*a, b* disposed within the upper end 24 of the body portion which are dimensioned to matingly engage a corresponding locking member 32 supported on the tail end 28, as described in greater detail below. The openings 26*a, b* may be rectangular in shape, and preferably extend continuously between the front 23 and rear 25 planar surfaces (i.e. the openings preferably do not taper between the planar surfaces). The openings are preferably separated by an intermediate section 27 of the body portion (FIG. 8). On the front planar surface, the intermediate section may include a tab 29, extending therefrom. The openings may also be bounded on the front surface by a raised wall 30, and the tab 29 may extend from the raised wall, as shown most clearly in FIG. 4. The raised wall 30 may be utilized to reinforce the locking openings and the latch mechanism in a closed position. The openings may preferably be centered on the width, "w", of the body portion, and are dimensioned to receive locking member 32 therein. In the present embodiment, each opening is generally rectangular, and is about 0.18 inches high, "$O_h$", and about 0.10 inches wide, "$O_w$", although other dimensions may readily be utilized as would be known to those of skill in the art. The openings receive locking member 32 which preferably extends from the front planar surface 23, and is supported on the tail end 28 of the body portion.

Figure 5:
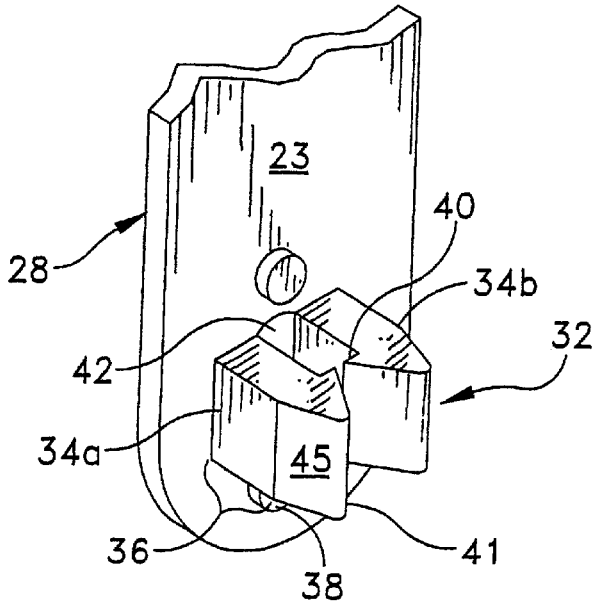
FIG. 5 is an enlarged perspective view of the locking member of the display hanger of FIG. 1.
Figure 6:
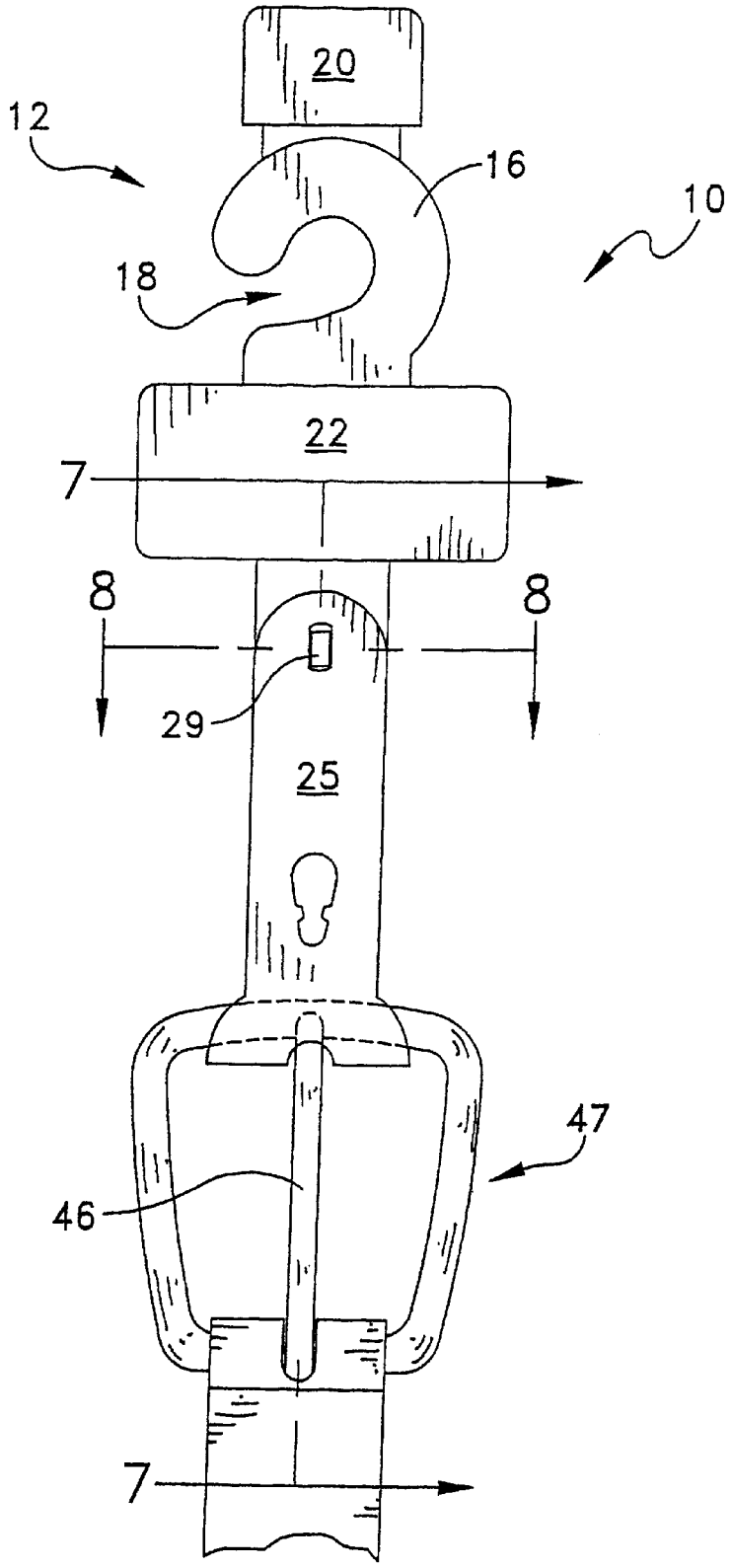
FIG. 6 is a front view of the embodiment of FIG. 1, including a conventional belt, in a secured or closed position.
Figure 7:
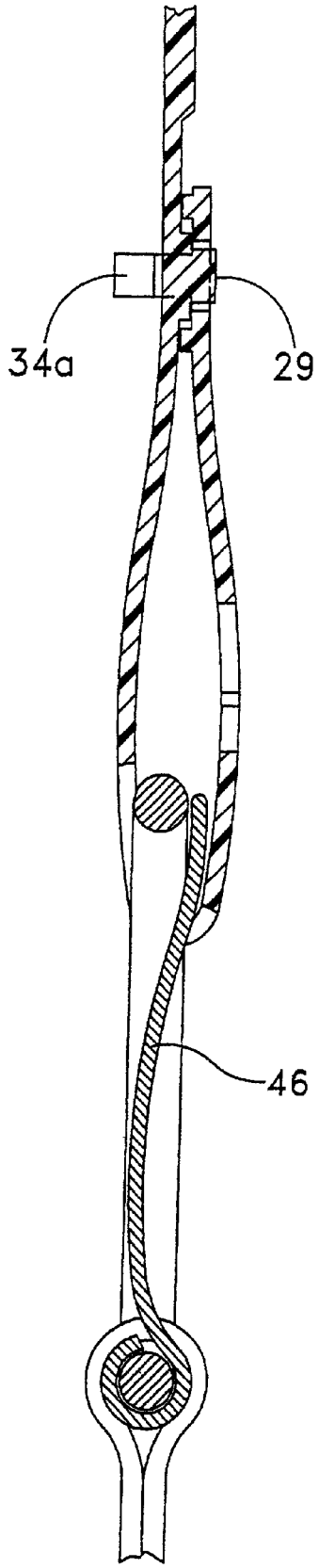
FIG. 7 is a side, cross-sectional view taken along lines 7—7 of FIG. 6.

Referring now to FIG. 5, the locking member 32 preferably includes at least a first and a second prong 34*a, b* which are dimensioned to engage corresponding openings 26*a, b* so as to secure or lock the belt hanger during use. In the present embodiment, the prongs each have a bottom section 36 supported on the front surface of the tail end, and a locking head 38 supported on the bottom section of the prong. The locking head preferably has a tapered construction, and each locking head further includes a detent or locking projection 40. Each locking projection 40 may preferably extend from an inside portion of each locking head, such that the locking projections are adjacent one another. The width of the locking heads at the locking projection is preferably wider than that of the locking openings in order to prevent retraction of the locking member from the openings once engaged, as described in greater detail below. The tapered construction facilitates insertion of the locking member within the openings by forming an angled head surface 45 where the width at a distal end or tip 41 of each head is smaller than the width of the locking openings. The width of the tip may also preferably be smaller than the width at the base 43 (FIG. 8) of the head (which preferably includes projection 40), and than the width of the bottom section 36 which is received within the openings. An intermediate opening 42 may also be disposed between the prongs 34*a, b*, the opening being dimensioned to receive the tab 29 therein. The opening 42 may also allow the prongs to move or flex in an outward direction during insertion of the prongs within the locking openings. In the present embodiment, the prongs are preferably aligned with corresponding locking openings, and may each have a width at their bottom portion, "$P_w$", of about 0.90 inches, a width at their widest point (i.e. at the locking projection), "$P_P$", of about 0.11 inches, and an overall height measured from the front planar surface, "$P_h$", of about 0.33 inches, although other dimensions may readily be utilized provided the locking member is sized to fit within the locking openings.

Positioned mid-way on the body portion is median or fold area 26. In the present embodiment, the fold area 26 includes an inverted T-shaped opening or slot 44 (FIG. 3). The T-shaped opening is dimensioned to receive a prong 46 of a conventional belt buckle 47, while facilitating folding of the body portion 14, as is known in the art and described in further detail herein below. A second, opening 48 may also be provided on the body portion, between the slot 44 and the locking member 32. The opening 48 may be utilized to secure stud and channel style buckles, as is known in the art. The median portion may preferably have an increased width, "$W_m$", in order to provide support to the belt buckle during use, and prevent tearing of the body portion in the area of the T-shaped opening. In the present embodiment, the diameter is approximately 0.73 inches, although other dimensions may readily be utilized as would be known to those of skill in the art.

Use of the display hanger 10 will now be described with reference to the drawings.

Figure 2:
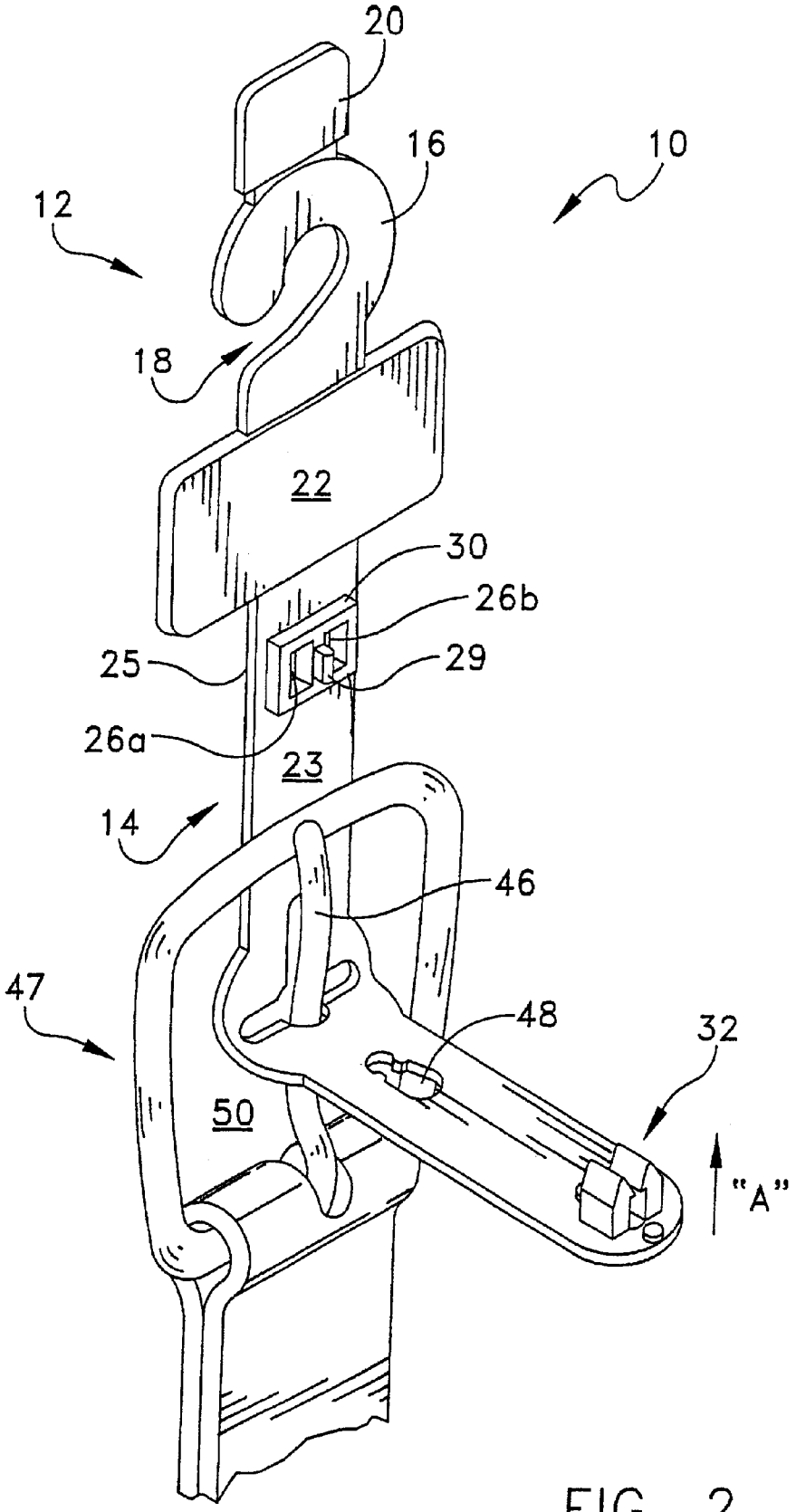
FIG. 2 is a perspective view of the display hanger of FIG. 1 in a non-secured, partially open position and showing the buckle of the conventional belt.

In use, the hanger 10 is initially in a non-secured position where the body portion is fully extended (FIG. 3). The rear planar surface is substantially flat such that multiple hangers may be stacked prior to assembly. When used with a conventional belt buckle 47 having a pivotable prong 46, the body portion of the hanger is preferably first inserted through opening 50 in the buckle, and the prong is pivoted and inserted within the T-shaped slot 44 (FIG. 2). The tail end 28 is then moved in the direction of arrow "A", such that the body portion is folded about the fold area 26 and slot 44. Once the body portion is folded, the locking member 32 is mated with the corresponding locking openings 26*a, b* by aligning each prong 34*a, b* with its corresponding opening, and inserting each prong into the opening. The prongs are inserted by the user applying a sufficient insertion force to the locking member such that the tapered heads 38 of the prongs move through the openings. Because the heads are tapered, insertion of the heads is facilitated by the angled head surface which allows for a minimum insertion force to be applied by the user. In addition, the tab 29 formed between the openings aids in alignment and insertion of the prongs by guiding the prongs into the openings. After the heads of the prongs are inserted through the openings, the locking projection 40 prevents the unauthorized removal or opening of the hanger by engaging the rear planar surface of the body portion as shown in FIG. 8. In particular, the locking projection 40 which extends from each prong head engages the rear planar surface of intermediate section 27 which is disposed between the two locking openings so as to prevent disengagement of the locking member. Once the prongs are inserted, the tab 29 may be seated within the opening disposed between the prongs. In order to remove the belt from the display hanger, the locking member must either be removed from engagement with the locking openings, or the body portion must be cut or otherwise broken. Generally, the locking member will not be able to be removed from the openings without severing the locking member from the body portion, or by otherwise destroying either the openings or the locking member. By having continuous locking openings which engage locking members having both a tapered head and a locking projection, the present hanger is easily assembled, tamper resistant and aesthetically pleasing.

It will be understood that various modifications may be made to the embodiment disclosed herein. For example, it should be understood that the display hanger need not be unitary in construction, that the length and dimensions may vary and fall within a range, that the stated dimensions are an illustrative embodiment, and that any suitable material may be utilized for the hanger, provided that the display hanger is foldable and can support the weight of a belt or other article (for example a bag or article of clothing) thereon. In addition, the display tab and display area are optional, if the display area is omitted the body portion may depend directly from the engagement member. Also, although shown as rectangular, the openings may be other shapes (as well as the corresponding locking member), as would be known to those of skill in the art. Therefore, the above description should not be construed as limiting, but merely as exemplifications of a preferred embodiment. Those skilled in the art will envision other modifications within the scope, spirit and intent of the invention.

What is claimed is:

1. A display hanger for supporting a belt, comprising:

an engagement member constructed and arranged to engage a display component;

an elongated, foldable body portion including a front planar surface, a rear planar surface, an upper end adjacent the engagement member, a tail end opposite the upper end, and a median area disposed between the upper end and the tail end;

a pair of locking openings disposed in the upper end of the body portion and extending continuously between the front planar surface and the rear planar surface, the locking openings being separated from each other by an intermediate section of the body portion;

a locking member extending from the front planar surface of the tail end of the body portion and including a first prong and a second prong, the first prong being dimensioned to fit within one of the locking openings and the second prong being dimensioned to fit within the other of the locking openings, each prong further including a locking head having a tapered surface and an outwardly extending locking projection;

a slot bounded by the median area of the body portion and constructed and dimensioned to receive a prong of a buckle of the belt; and wherein upon folding the body portion and inserting the first and second prongs through the locking openings, the locking member is secured within the openings such that the locking projection engages a rear surface of the upper end of the body portion in order to secure the locking member in engagement with the locking openings, and the median area forms a surface constructed and arranged to support the belt buckle such that the belt buckle is locked within the display hanger.

2. The display hanger of claim 1, wherein the locking projection extends from an inside portion of each locking head such that the locking projections are adjacent each other and engage the intermediate section when disposed through the openings.

3. The display hanger of claim 1, further comprising a tab extending from a front surface of the intermediate section.

4. The display hanger of claim 3, further comprising an intermediate opening disposed between the first and second prongs and dimensioned to receive the tab therein.

5. The display hanger of claim 1, wherein the median area has a width greater than the width of the upper end and the tail end.

6. The display hanger of claim 5, wherein the slot is a T-shaped slot disposed in the median area of the body portion.

7. The display hanger of claim 1, wherein the engagement member is a hook.

8. The display hanger of claim 1, further comprising a tab supported on a top portion of the engagement member, and a logo display area supported between a bottom portion of the engagement member and the upper end of the body portion.

9. The display hanger of claim 1, wherein each locking head is tapered such that each includes a tip having a width which is smaller than a width of the locking openings.

10. The display hanger of claim 1, wherein the locking openings have a rectangular shape.

11. The display hanger of claim 1, wherein the openings are bounded on the front planar surface by a raised wall.

12. The display hanger of claim 1, wherein the first and second prongs each include a bottom section supported on the front surface and wherein the locking head of each prong is supported on the bottom section.

13. The display hanger of claim 1, wherein locking member is supported on the tail end of the hanger.

14. A display hanger for supporting an article, comprising:

a hook-shaped engagement member constructed and arranged to engage a display rod;

an elongated, foldable body portion including a front planar surface, a rear planar surface, an upper end adjacent the engagement member, a tail end opposite the upper end, and a median area disposed between the upper end and the tail end;

a pair of locking openings disposed in the body portion and extending continuously between the front planar surface and the rear planar surface, the locking openings being separated from each other by an intermediate section of the body portion;

a locking member supported on the tail end and extending from the front planar surface, the locking member including a first prong and a second prong, the first prong being dimensioned to fit within one of the locking openings and the second prong being dimensioned to fit within the other of the locking openings, each prong further including:

a bottom section supported on the front planar surface of the body portion; and a locking head supported on the bottom section, the locking head having a tapered outer surface and a locking projection;

a slot bounded by the median area of the body portion and constructed and dimensioned to receive a prong of a belt buckle;

wherein upon folding the body portion and inserting the first and second prongs through the locking openings, the locking member is secured within the openings such that the locking projection engages a rear surface of the upper end of the body portion in order to secure the locking member in engagement with the locking openings, and the median area forms a surface constructed and arranged to support the belt buckle such that the belt buckle is locked within the display hanger.

15. A display hanger for supporting an article, comprising:

a hook-shaped engagement member constructed and arranged to engage a display rod;

an elongated, foldable body portion including a front planar surface, a rear planar surface, an upper end adjacent the engagement member, a tail end opposite the upper end, and a median area disposed between the upper end and the tail end;

a pair of locking openings disposed in the body portion and extending continuously between the front planar surface and the rear planar surface, the locking openings being separated from each other by an intermediate section of the body portion;

a locking member supported on the tail end and extending from the front planar surface, the locking member including a first prong and a second prong, the first prong being dimensioned to fit within one of the locking openings and the second prong being dimensioned to fit within the other of the locking openings, each prong further including:

a bottom section supported on the front planar surface of the body portion; and a locking head supported on the bottom section, the locking head having a tapered outer surface and a locking projection;

a slot disposed in the median area of the body portion and constructed and dimensioned to receive a prong of a belt buckle;

wherein upon folding the body portion and inserting the first and second prongs through the locking openings, the locking member is secured within the openings such that the locking projection engages a rear surface of the intermediate section in order to secure the locking member in engagement with the locking openings.

16. The hanger of claim 15, further comprising a tab extending from a front surface of the intermediate section, and an intermediate opening disposed between the first and second prongs, the intermediate opening being dimensioned to receive the tab therein.

17. The display hanger of claim 15, further comprising a tab supported on a top portion of the engagement member, and a logo display area supported between a bottom portion of the engagement member and the upper end of the body portion.

18. The display hanger of claim 1, wherein the locking projection extends from an inside portion of each locking head such that the locking projections are adjacent each other and engage the intermediate section when disposed through the openings.

19. A method of assembling a display hanger, comprising the steps of:

providing a hanger including an elongated body portion having a front surface, a rear surface, an upper end adjacent the engagement member, a tail end opposite the upper end, a median area disposed between the upper end and the tail end, a locking member supported on the tail end, a first and a second opening disposed in the upper end and constructed and dimensioned to receive the locking member, and a slot bounded by the median area of the body portion and constructed and dimensioned to receive a prong of a belt buckle;

folding the elongated body portion about the median area such that the median area forms a surface constructed and arranged to support a belt buckle; and inserting the locking member within the first and second locking openings such that the locking member engages the rear surface of upper end of the body portion in order to secure the locking member in engagement with the locking openings.

20. The method of claim 19, wherein upon securing the locking member within the openings, the locking member can not be removed from within the openings without damaging the display hanger in order to lock the belt within the hanger.

* * * * *